US006564388B1

(12) United States Patent
Poston

(10) Patent No.: US 6,564,388 B1
(45) Date of Patent: May 20, 2003

(54) MULTI-PURPOSE CARRY BAG AND METHOD THEREFOR

(76) Inventor: Ody Merlin Poston, 1898 Eagle Flight La., Henderson, NV (US) 89012

( * ) Notice: Subject to any disclaimer, the term of this patent is extended or adjusted under 35 U.S.C. 154(b) by 0 days.

(21) Appl. No.: 10/045,729

(22) Filed: Jan. 15, 2002

(51) Int. Cl.[7] ..... A41D 3/02
(52) U.S. Cl. ..... 2/86; 2/84; 2/94
(58) Field of Search ..... 2/84, 85, 86, 87, 2/88, 89, 93, 94, 69, 108, 69.5, 247, 311, 46; 224/153, 576, 577

(56) References Cited

U.S. PATENT DOCUMENTS 1,797,208 A * 3/1931 Weisz
2,165,348 A * 7/1939 Daiber ..... 2/94
2,248,455 A * 7/1941 Freund ..... 2/94
2,325,494 A * 7/1943 Fayer ..... 2/93
2,375,655 A * 5/1945 Irvin ..... 224/5
2,507,322 A * 2/1950 Smith ..... 2/97
4,389,735 A * 6/1983 McLaughlin ..... 2/94
4,404,687 A * 9/1983 Hager ..... 2/94
4,475,251 A * 10/1984 Hopkins ..... 2/94
4,502,155 A * 3/1985 Itoi ..... 2/115
4,563,777 A * 1/1986 Park ..... 2/108
4,689,831 A * 9/1987 Greenberger et al. ..... 2/93
4,932,574 A * 6/1990 Doshi ..... 224/153
4,949,401 A * 8/1990 Kimsey, Jr. ..... 2/102
5,101,514 A * 4/1992 Eklund ..... 2/94
5,123,117 A * 6/1992 Prendergast ..... 2/108
5,165,111 A * 11/1992 Lieberman ..... 2/94
5,278,998 A * 1/1994 Book ..... 2/102
5,407,112 A * 4/1995 Christodoulou et al. .... 224/153
5,452,476 A * 9/1995 Jenks ..... 2/46
5,564,125 A * 10/1996 Waldman et al. ..... 2/93
5,592,691 A * 1/1997 Ronald ..... 2/69
5,664,257 A * 9/1997 Hall ..... 2/69
5,699,560 A * 12/1997 Greenberg ..... 2/94
5,724,672 A * 3/1998 Chen ..... 2/69
5,860,164 A * 1/1999 Johnson ..... 2/94
6,134,712 A * 10/2000 Spector ..... 2/94
6,315,178 B1 * 11/2001 Nobata ..... 224/153
6,354,477 B1 * 3/2002 Trummer ..... 224/575
6,370,692 B1 * 4/2002 Duyn et al. ..... 2/86
6,385,775 B1 * 5/2002 Komjati ..... 2/86
6,405,377 B1 * 6/2002 Davis ..... 2/94
6,421,834 B2 * 7/2002 Kester ..... 2/94

* cited by examiner

*Primary Examiner*—John J. Calvert
*Assistant Examiner*—Alissa L. Hoey
(74) *Attorney, Agent, or Firm*—Craig Weiss; Harry M. Weiss; Weiss, Moy & Harris, P.C.

(57) ABSTRACT

A multi-purpose carry bag and method therefore capable of being easily configured into a hooded jacket, a backpack and a carry bag, with the hooded jacket coupled to the backpack and capable of being folded into and out of the backpack, and the backpack coupled to the carry bag and capable of being folded into and out of the carry bag.

18 Claims, 2 Drawing Sheets

MULTI-PURPOSE CARRY BAG AND METHOD THEREFOR

FIELD OF THE INVENTION

This invention relates generally to carry bags and, more specifically, to a multi-purpose carry bag and method therefor capable of being easily configured into three different objects; (a) a hooded jacket; (b) a backpack; and (c) a carry bag. The backpack is coupled to an interior portion of the carry bag with the carry bag dimensioned to house the backpack, and the hooded jacket is coupled to an interior portion of the backpack with the backpack dimensioned to house the hooded jacket.

BACKGROUND OF THE INVENTION

It is often the case that one has a need for a carry bag in some situations, a backpack in other situations and a hooded jacket in still other situations. Each of these items serves a purpose, whether it is for fashion or utility. A carry bag is relatively small and is often carried over a shoulder or in one hand. A backpack has a larger carrying capacity and is therefore often carried over one or both shoulders. A hooded jacket is useful to protect one's self from rain, wind and cold. It is often the case however, that throughout the day, one's needs change, either due to a change in the weather, an increased need for carrying capacity or a change in the level of fashion.

It is burdensome and unrealistic for a person to carry all of those items at once. Additionally, most hooded jackets provide only a covering for the body without giving the wearer any place to store both smaller items, such as sunglasses and keys as well as larger items, such as clothes and books.

A need therefore existed for a multi-purpose carry bag capable of being expanded into a backpack, which in turn, is capable of being expanded into a hooded jacket so that a front portion of the hooded jacket is coupled to the backpack. In this way, a person could use any one of these three items by folding one into the other or unfolding one out of the other as the situation merits.

SUMMARY OF THE INVENTION

An object of the present invention is to provide a multi-purpose carry bag having the ability to transform itself into a backpack and from a backpack into a hooded jacket and vice-versa in order to provide a person with the ability to use a carry bag, a backpack or a hooded jacket as needed.

It is a further object of the present invention to provide a hooded jacket having a backpack coupled to a front portion thereof in order to provide a hooded jacket wearer with easily accessible storage space.

BRIEF DESCRIPTION OF THE PREFERRED EMBODIMENTS

In accordance with one embodiment of the present invention, a multi-purpose carry bag is disclosed, comprising, in combination, a hooded jacket having a top hood portion and an open bottom portion and a back portion and a front portion, a backpack having a front portion and a back portion, the back portion of the backpack has at least one strap coupled thereto, an interior portion of the backpack is coupled to the front portion of the hooded jacket and the interior portion of the backpack is dimensioned to house the hooded jacket, and a carry bag, an interior portion of the carry bag is coupled to the front portion of the backpack, the interior of the carry bag is dimensioned to house the backpack.

In accordance with another embodiment of the present invention, a method for transforming a multi-purpose carry bag into one of three configurations is disclosed, comprising, in combination, the steps of providing a hooded jacket having a top hood portion and an open bottom portion and a back portion and a front portion, providing a backpack having a front portion and a back portion, the back portion of the backpack has at least one strap coupled thereto, an interior portion of the backpack is coupled to the front portion of the hooded jacket and the interior portion of the backpack is dimensioned to house the hooded jacket, and providing a carry bag, an interior portion of the carry bag is coupled to the front portion of the backpack, the interior of the carry bag is dimensioned to house the backpack.

The foregoing and other objects, features, and advantages of the invention will be apparent from the following, more particular description of the preferred embodiments of the invention, as illustrated in the accompanying drawings.

DETAILED DESCRIPTION OF THE PREFERRED EMBODIMENTS

Figure 1:
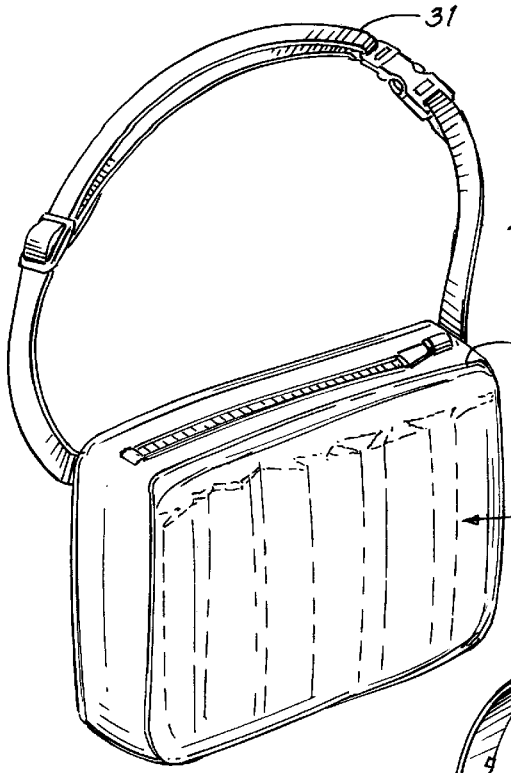
FIG. 1 is a perspective view showing the multi-purpose carry bag of the present invention in a carry bag configuration.
Figure 3:
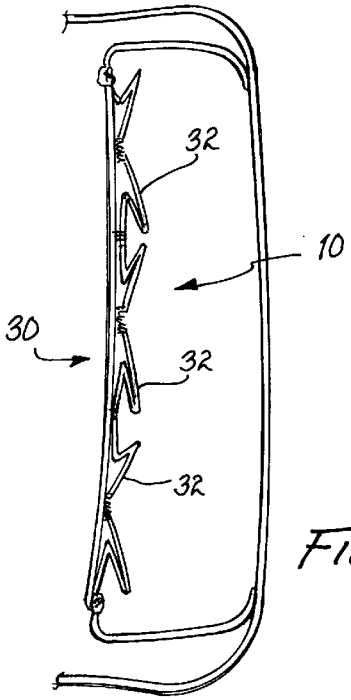
FIG. 3 is a sectional view taken along the line 3—3 of FIG. 2, showing pockets on the front portion of the carry bag located within the backpack.
Figure 4:
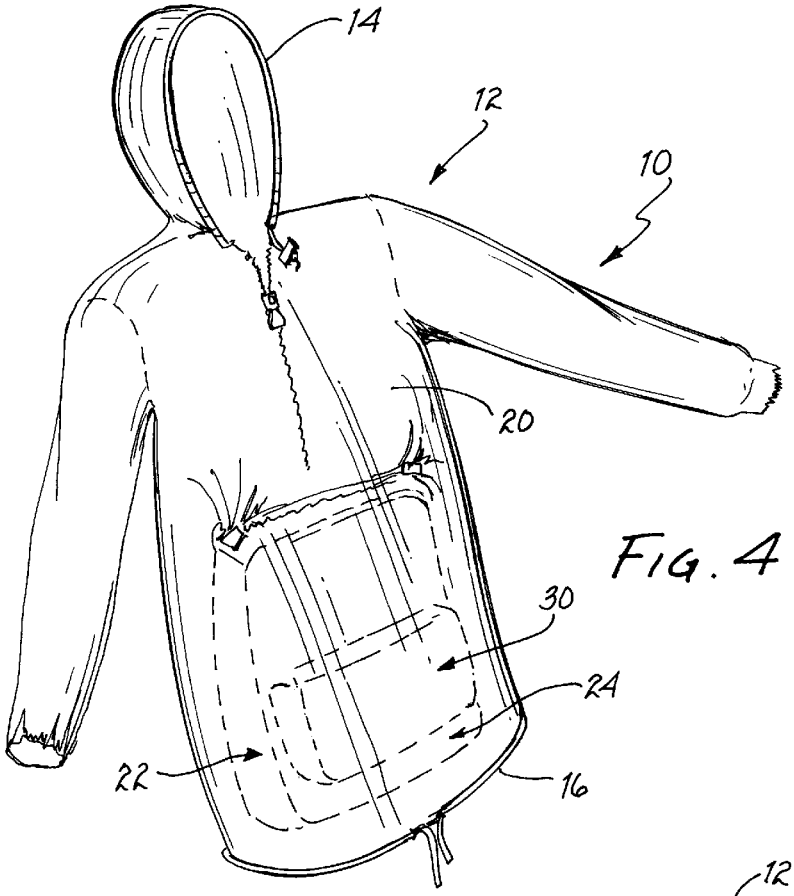
FIG. 4 is a perspective view showing a hooded jacket having the backpack located therein with the carry bag located within the backpack.

Referring to FIGS. 1–5, the multi-purpose carry bag, hereinafter multi-purpose carry bag 10, of the present invention, is shown. The multi-purpose carry bag 10 comprises a hooded jacket 12 (shown in FIGS. 4–5) having a top hood portion 14 (shown in FIG. 4) and an open bottom portion 16 and a back portion 18 (shown in FIG. 5) and a front portion 20 (shown in FIG. 4). The front portion 20 of the hooded jacket 12 is coupled to an interior portion of a backpack 22 (shown in FIGS. 2, 2*a* and 4). In this way, the wearer of the hooded jacket 12 has immediate access to the interior of the concealed backpack 22 to place and retrieve items. When the hooded jacket 12 is not in use the entire hooded jacket 12 can be folded into the interior of the backpack 22. In the preferred embodiment, the back portion 18 of the hooded jacket 12 comprises a glow patch 19 (shown in FIG. 5) dimensioned to reflect light. The purpose of the glow patch 19 is to warn cars and other passersby of the location of the wearer or the hooded jacket 12. While, in the preferred embodiment, the back portion 18 of the hooded jacket 12 comprises a glow patch 19 it should be clearly understood that substantial benefit could be derived from an alternative configuration of the hooded jacket 12 in which no reflective material is used. In the preferred embodiment, the multi-purpose carry bag 10 further comprises a seat cover 21 (shown in FIG. 5) coupled to the back portion 19 of the hooded jacket 12 proximate the open bottom portion 16. The seat cover 21 is dimensioned to be lowered from the back portion 18 of the hooded jacket 12 to cover a seat (not shown) when a wearer of the hooded jacket 12 moves to a seated position. It is often the case that one wears a hooded jacket due to rain, and the rain generally causes outdoor seats to become wet. As a result, many people often rest a newspaper, a sweater or some other item on a seat to avoid getting the bottom of their pants wet. The seat cover 21 can be lowered from the hooded jacket 12, preferably by detaching an upper end of the seat cover 21 held in place preferably by hooks and loops fastening material, and placed on a seat as the wearer of the hooded jacket 12 moves into a seated position. While, in the preferred embodiment, the multi-purpose carry bag 10 comprises a seat cover 21, it should be clearly understood that substantial benefit could be derived from an alternative configuration of the multi-purpose carry bag 10 in which there is no seat cover 21 or in which the seat cover 21 is coupled to the hooded jacket 12 or deployed from the hooded jacket 12 in some other configuration.

Figure 2:
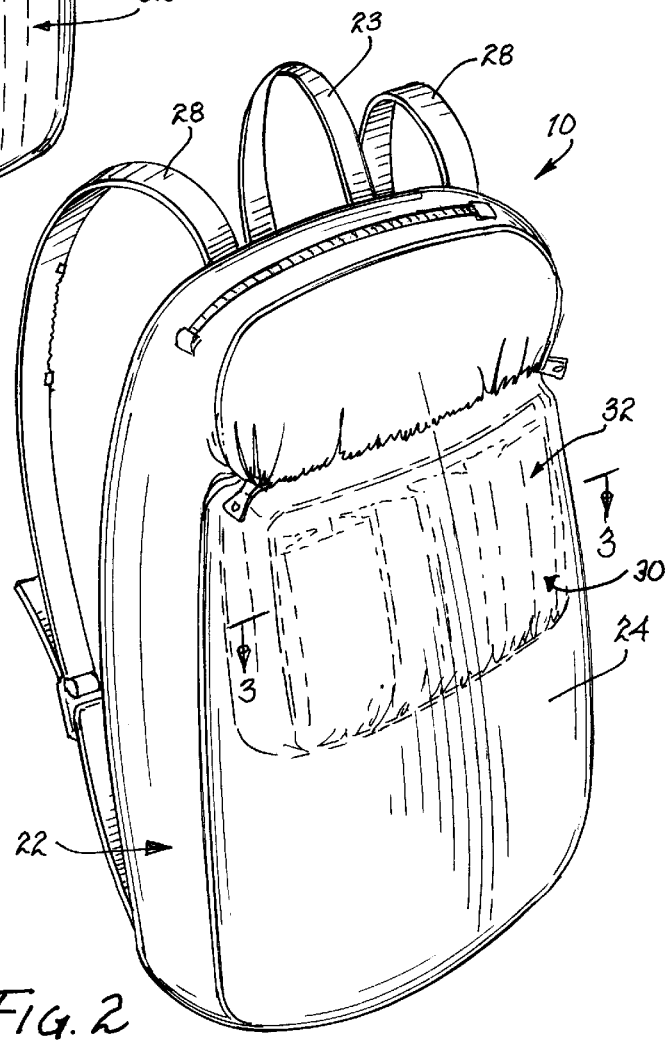
FIG. 2 is a perspective view showing the multi-purpose carry bag of the present invention located within an exterior backpack configuration.
Figure 2A:
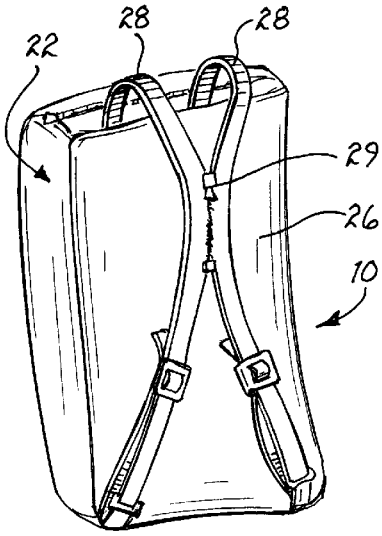
FIG. 2*a* is a back, perspective view a backpack similar to the backpack of FIG. 2, however, showing a split shoulder strap configuration coupled to a back portion of the backpack and capable of being separated into two shoulder straps.
Figure 5:
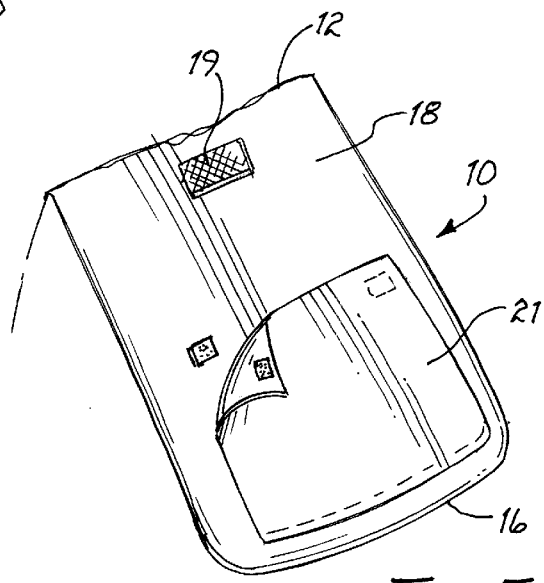
FIG. 5 is a back, perspective view of a portion of the hooded jacket of FIG. 4, showing a glow patch and seat cover.

The backpack 22 has a front portion 24 (shown in FIGS. 2 and 4) and a back portion 26 (shown in FIG. 2*a*). The back portion 26 has at least one strap 28 coupled thereto. In the preferred embodiment, the back portion 26 of the backpack 22 comprises a shoulder strap 28 dimensioned to be separated, preferably by a zipper 29 (shown in FIG. 2*a*), into two shoulder straps (as shown in FIG. 2*a*) at the discretion of the wearer. While, in the preferred embodiment, the backpack 22 comprises a shoulder strap 28 dimensioned to be separated into two shoulder straps 28, it should be clearly understood that substantial benefit could be derived from an alternative configuration of the multi-purpose carry bag 10 in which the backpack 22 comprises only one shoulder strap 28 or two shoulder straps which cannot be combined or separated. Preferably, a handle strap 23 is coupled to a top portion of the backpack 22 (see FIG. 2). The handle strap 23 could be used as an additional means of carrying the backpack 22, although it should be clearly understood that substantial benefit could be derived from an alternative configuration in which there is no handle strap 23.

Referring now to FIGS. 1–4, the multi-purpose carry bag 10 further comprises a carry bag 30. An interior portion of the carry bag 30 is coupled to and located within the front portion 24 of the backpack 22. When the backpack 22 is not in use the entire backpack 22 (including the hooded jacket 12 that is folded into the backpack 22) can be folded into the interior of the carry bag 30. In the preferred embodiment, a plurality of pockets 32 (shown more clearly in FIGS. 1–3) are coupled to a front side of the carry bag 30. The pockets 32 can be used to store sunglasses, keys, change, and the like. In the backpack 22 configuration of the multi-purpose carry bag 10, the exterior pockets 32 of the carry bag 30 are located on the inside of the front portion 24 of the backpack 22 and can therefore be used by the backpack 22 wearer to place and remove items which are concealed. Therefore, in the carry bag 30 configuration of the multi-purpose carry bag 10, the pockets 32 can be efficiently used by the carry bag 30 holder to place and remove items. While, in the preferred embodiment, a plurality of pockets 32 are coupled to a front side of the carry bag 30 it should be clearly understood that substantial benefit could be derived from an alternative configuration of the multi-purpose carry bag 10 in which only one pocket is coupled to the carry bag 30, or in which, if desired, there are no pockets.

Preferably, the hooded jacket 12, the backpack 22 and the carry bag 30 comprise a water repellant or, resistant type material, such as nylon, although it should be clearly understood that substantial benefit could be derived from an alternative configuration of the multi-purpose carry bag 10 in which another material is used, so long as the material is sufficiently light and pliable so as to permit the hooded jacket 12 to be easily folded into and out of the backpack 22 and the backpack 22 to be easily folded into and out of the carry bag 30.

In the preferred embodiment, the carry bag 30 comprises a support strap 31 (see FIG. 1) coupled proximate a top portion of the carry bag 30. The support strap 31 serves several purposes. In its most basic embodiment, the support strap 31 is used to hold or carry the carry bag 30. Preferably, the support strap 31 is connected to the carry bag 10, but can, if desired, be detachable. If desired, each end of the strap 31 can be wrapped around the torso of a person and the ends are reattached in order to further secure the carry bag 30 and the inner backpack 22 to the person in a waist bag or pouch configuration. When the multi-purpose carry bag 10 is converted into the hooded jacket 12 configuration, the support strap 31 is dimensioned to be detached into two separate ends with each end then being wrapped around the waist of a person. The ends are then reattached in order to further secure the inner backpack 22 and the hooded jacket 12 to the person. While, in the preferred embodiment, the multi-purpose carry bag 10 comprises a support strap 31, it should be clearly understood that substantial benefit could be derived from an alternative configuration of the multi-purpose carry bag 10 in which there is no support strap 31.

While the invention has been particularly shown and described with reference to preferred embodiments thereof, it will be understood by those skilled in the art that the foregoing and other changes in form and details may be made therein without departing from the spirit and scope of the invention.

I claim:

1. A multi-purpose carry bag comprising, in combination:

a hooded jacket having a top hood portion and an open bottom portion and a back portion and a front portion;

a backpack having a front portion, a back portion and an access port separating the front portion from the back portion, said back portion of said backpack has at least one strap coupled thereto, said at least one strap of said backpack is a shoulder strap dimensioned to be separated into two shoulder straps, an interior portion of said backpack is coupled to said front portion of said hooded jacket and the interior portion of said backpack is dimensioned to house said hooded jacket; and a carry bag, an interior portion of said carry bag is coupled to said front portion of said backpack, the interior of said carry bag is dimensioned to house said backpack.

2. The multi-purpose carry bag of claim 1 further comprising a plurality of pockets coupled to a front side of said carry bag.

3. The multi-purpose carry bag of claim 1 further comprising a handle strap coupled to a top portion of said backpack.

4. The multi-purpose carry bag of claim 1 wherein said carry bag and said backpack and said hooded jacket are comprised of water resistant type material.

5. The multi-purpose carry bag of claim 1 further comprising a support strap coupled proximate a top portion of said carry bag.

6. The multi-purpose carry bag of claim 5 wherein said support strap is dimensioned to wrap around a torso of a person to secure said carry bag and said backpack located therein to a person, and therefore also secure said hooded jacket located within said backpack to a person.

7. The multi-purpose carry bag of claim 1 further comprising a glow patch coupled to said back portion of said hooded jacket and dimensioned to reflect light.

8. The multi-purpose carry bag of claim 1 further comprising a seat cover coupled to said back portion of said hooded jacket proximate said open bottom portion, said seat cover is dimensioned to be lowered from said back portion of said hooded jacket to cover a seat when a wearer of said hooded jacket moves to a seated position.

9. A method for transforming a multi-purpose carry bag into one of three configurations comprising, in combination, the steps of:

providing a hooded jacket having a top hood portion and an open bottom portion and a back portion and a front portion;

providing a backpack having a front portion and a back portion, said back portion of said backpack has at least one strap coupled thereto, an interior portion of said backpack is coupled to said front portion of said hooded jacket and the interior portion of said backpack is dimensioned to house said hooded jacket;

providing a carry bag, an interior portion of said carry bag is coupled to said front portion of said backpack, said interior portion of said carry bag is dimensioned to house said backpack, and providing a shoulder strap coupled to said back portion of said backpack and dimensioned to be separated into two shoulder straps; and separating said shoulder strap into two shoulder straps.

10. The method of claim 9 further comprising the step of folding said hooded jacket into the interior of said backpack.

11. The method of claim 10 further comprising the step of folding said backpack into the interior of said carry bag.

12. The method of claim 10 further comprising the step of unfolding said backpack from the interior of said carry bag.

13. The method of claim 12 further comprising the step of unfolding said hooded jacket from said interior portion of said backpack.

14. The method of claim 9 further comprising the step of providing a support strap coupled proximate a top portion of said carry bag.

15. The method of claim 14 further comprising the steps of:

detaching said support strap;

wrapping said support strap around a torso of a person; and reattaching said support strap to secure said carry bag and said backpack located therein to a person.

16. The method of claim 14 further comprising the steps of:

detaching said support strap;

wrapping said support strap around a waist of a person; and reattaching said support strap to secure said carry bag, said backpack located therein and said hooded jacket located within said backpack to a person.

17. The method of claim 9 further comprising the step of providing a plurality of pockets coupled to said front side of said carry bag.

18. The method of claim 9 further comprising the steps of:

providing a seat cover coupled to said back portion of said hooded jacket proximate said open bottom portion; and lowering said seat cover from said back portion of said hooded jacket in order to cover a seat when a wearer of said hooded jacket moves to a seated position.

* * * * *